US008764909B2

(12) United States Patent
Classen et al.

(10) Patent No.: US 8,764,909 B2
(45) Date of Patent: Jul. 1, 2014

(54) WATER-CONDUCTING DOMESTIC APPLIANCE COMPRISING A DETERGENT DOSING SYSTEM THAT HAS A DOSING DEVICE

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1136 days.

(21) Appl. No.: 12/311,096

(22) PCT Filed: Aug. 29, 2007

(86) PCT No.: PCT/EP2007/058955

§ 371 (c)(1), (2), (4) Date: Mar. 18, 2009

(87) PCT Pub. No.: WO2008/034689

PCT Pub. Date: Mar. 27, 2008

(65) Prior Publication Data

US 2009/0235963 A1 Sep. 24, 2009

(30) Foreign Application Priority Data

Sep. 19, 2006 (DE) ..... 10 2006 043 919

(51) Int. Cl.

| | |
|---|---|
| ***B08B 3/00*** | (2006.01) |
| ***B08B 7/00*** | (2006.01) |
| ***B08B 7/04*** | (2006.01) |
| ***A47L 15/44*** | (2006.01) |
| ***D06F 39/02*** | (2006.01) |
| ***B08B 3/02*** | (2006.01) |

(52) U.S. Cl.

CPC ..... *A47L 15/44* (2013.01); *A47L 15/4418* (2013.01); *A47L 15/4463* (2013.01); *A47L 15/449* (2013.01); *D06F 39/02* (2013.01); *D06F 39/022* (2013.01); *B08B 3/02* (2013.01); *B08B 3/006* (2013.01)

USPC .... 134/56 D; 134/57 D; 134/58 D; 134/56 R; 68/17 R; 68/3 R; 68/12.02; 68/12.19; 68/207

(58) Field of Classification Search

CPC ..... B08B 3/02; B08B 3/006; A47L 15/44; A47L 15/4463; A47L 15/449; D06F 39/02; D06F 39/022

USPC ..... 134/57 D, 56 D, 58 D, 99.2, 56 R, 94.1; 68/17 R, 207 R, 3, 12.02, 12.19, 207, 68/12.19 R

See application file for complete search history.

(56) References Cited

U.S. PATENT DOCUMENTS 2,861,581 A * 11/1958 Ryckman, Jr. ..... 134/58 R
2,888,174 A * 5/1959 Bauerlein ..... 222/212

(Continued)

FOREIGN PATENT DOCUMENTS

DE 19821414 A1 11/1999
DE 19947324 A1 4/2001

(Continued)

*Primary Examiner* — Alexander Markoff

(74) *Attorney, Agent, or Firm* — James E. Howard; Andre Pallapies

(57) ABSTRACT

A water-conducting appliance, including a compartment for receiving items therein for washing; and a cleaning agent dosing system having a dosing device for dosing at least one cleaning agent, in particular a liquid cleaning agent, into the washing compartment, the dosing device including a dosing chamber for holding a cleaning agent, an outlet, a gate for opening and closing the dosing chamber, and an actuator system for actuating the gate to move between an opening position and a closing position, the actuator system including transfer means operably connected to the gate such that a predetermined movement of the transfer means moves the gate, opening means for moving the transfer means in a first direction operable to open the gate, and return means for moving the transfer means in a second direction to close the gate.

15 Claims, 6 Drawing Sheets

(56) References Cited

U.S. PATENT DOCUMENTS

| | | | | |
|---|---|---|---|---|
| 2,985,177 | A * | 5/1961 | Gilson | 134/56 R |
| 3,378,933 | A * | 4/1968 | Jenkins | 34/570 |
| 3,621,856 | A * | 11/1971 | Guth | 134/58 D |
| 3,739,942 | A * | 6/1973 | Mercer et al. | 222/54 |
| 4,736,587 | A * | 4/1988 | Suzuki | 60/528 |
| 5,396,769 | A | 3/1995 | Brudnicki | |
| 6,138,693 | A * | 10/2000 | Matz | 134/57 D |
| 2003/0051513 | A1 * | 3/2003 | Castelli et al. | 68/12.18 |
| 2004/0118434 | A1 * | 6/2004 | Virgilio et al. | 134/18 |
| 2005/0109071 | A1 * | 5/2005 | Dirnberger et al. | 68/3 R |
| 2006/0123852 | A1 * | 6/2006 | Wiedemann et al. | 68/13 R |
| 2008/0047620 | A1 * | 2/2008 | Jerg | 137/522 |

FOREIGN PATENT DOCUMENTS

| | | | |
|---|---|---|---|
| DE | 10217061 | A1 | 3/2003 |
| DE | 10208213 | A1 | 9/2003 |
| GB | 2402604 | A | 12/2004 |
| WO | WO 2006069835 | A1 * | 7/2006 |

* cited by examiner

WATER-CONDUCTING DOMESTIC APPLIANCE COMPRISING A DETERGENT DOSING SYSTEM THAT HAS A DOSING DEVICE

BACKGROUND OF THE INVENTION

The majority of domestic dishwashers currently in use have an adding device for holding one or more cleaning agents which are added to the washing liquid during the course of a washing cycle for the purpose of cleaning the washable items that have been placed in the dishwasher. The cleaning agent which has been preloaded into the adding device is usually fully released into the washing compartment during the washing cycle and mixed with the washing liquid that is circulated there. In terms of size, the adding device is dimensioned such that it can be filled with exactly the amount of cleaning agent that is required for one washing cycle. The dishwasher user is therefore obliged to fill the adding device with the amount of cleaning agent required for the cleaning cycle at the start of each washing cycle. This operation is inconvenient for the user of the dishwasher. Moreover, in the case of such dishwashers, the problem arises that the amount of cleaning agent loaded into the adding device can vary from user to user, and also from washing operation to washing operation. An incorrectly dosed amount of cleaning agent can lead to unsatisfactory washing results if the cleaning-agent dose is too small on one hand, and can result in a waste of cleaning agent and hence an adverse effect on the environment if a dosed amount of cleaning agent is too large on the other hand.

Furthermore, adding devices which add the amount of cleaning agent stored therein to the washing liquid all at once do not allow more complex washing programs to be performed. For example, in certain situations it might be suitable to add the cleaning agent to the washing liquid at different instants. Adding devices which are designed for holding a single cleaning-agent dose cannot support complex washing cycles of this type.

BRIEF SUMMARY OF THE INVENTION

The invention addresses the problem of providing a water-conducting domestic appliance which comprises a cleaning-agent dosing system and is inexpensive to realize. Furthermore, the invention addresses the problem of providing a corresponding cleaning-agent dosing system.

The problem is solved by the patent claim 1. Advantageous embodiments are derived in each case from the dependent patent claims.

The water-conducting domestic appliance according to the invention, in particular a domestic dishwasher with a cleaning-agent dosing system, features a device for dosing at least one fluid into the washing compartment of a dishwasher, a chamber for holding at least one added fluid, and an outlet which can be opened and closed by means of a gate. The cleaning-agent dosing system is designed e.g. for installation adjacent to a washing compartment of the dishwasher within the dishwasher, and contains at least one cleaning agent, wherein the preloaded amount of cleaning agent is greater than the amount that is required for one washing cycle. In this case, "adjacent to a washing compartment" means that the cleaning-agent dosing system is permanently integrated into a part of the dishwasher, e.g. a side wall of the housing or a door of the dishwasher. Furthermore, the cleaning-agent dosing system features a connection to the dishwasher control unit. Cleaning agents can be compositions of a multiplicity of cleaning components or individual cleaning substances such as an enzyme, for example. The cleaning agents can take the form of a liquid or a gel. The cleaning agents can be arranged in a plurality of chambers of the cartridge. However, provision can also be made for the cleaning-agent dosing system to be designed so as to hold a corresponding number of cartridges comprising just one chamber. The gate can be activated by means of an actuator system, wherein the actuator system comprises the following features according to the invention: provision is made for a transfer means which has an active connection to the gate, such that a movement of the transfer means causes a movement of the gate. In this case, the transfer means can be rotatably mounted, wherein its axis of rotation is arranged parallel with or essentially parallel with a direction of movement of the gate and the transfer means is actively connected to the gate such that a rotational movement of the transfer means results in a movement of the gate. The actuator system also comprises opening means which cause a movement, e.g. a rotational movement, of the transfer means in a first direction for the purpose of opening the gate, and return means which cause a movement, e.g. a rotational movement, of the transfer means in a second direction for the purpose of closing the gate.

A device according to the invention is distinguished by its modest space requirement, a simple and robust mechanism, and high cost efficiency. The device allows the precise dosing and/or adding of a fluid, in particular a cleaning agent.

It is possible to manufacture the device in a particularly economical and simple manner because the actuator system is arranged on a support which forms a wall section of the chamber. Consequently, the actuator system can be manufactured separately from the chamber, this being part of a cleaning-agent dosing system which is described subsequently. This separate manufacture has the advantage that preassembly of the actuator system including all control means is possible. During the manufacturing processes, it is merely necessary to connect the support with the actuator system to the chamber.

The support can have the functionality of a circuit board and provide an electrical wiring. In this case, the support can feature conductor paths on at least one of its main sides and/or internally. In particular, the support can be manufactured using the so-called insert technique, according to which conductor paths are coated with support material.

The gate comprises a valve lifter with a valve stem and a valve head, wherein the valve stem can project through the support in such a way that the valve head lies outside of the chamber and the transfer means is arranged between the valve head and the support. The transfer means preferably features a wedge-shaped or ridge-shaped projection which increases the distance between the valve head and the transfer means in the case of a rotational movement in the first direction, for example, such that a movement of the valve stem is effected.

By virtue of the rotational movement, the projection moves under the valve head, such that an increasing angle of rotation results in a movement of the valve stem away from the outlet. A movement of the valve stem in the opposite direction can be effected by further rotation or by rotational movement in the opposite direction (generally: in a second direction), such that the outlet is closed by the gate as a result.

In an embodiment, the opening means features a first shape-memory alloy which effects the rotational movement of the transfer means in the first direction in response to a control signal. A shape-memory alloy is used for converting thermal energy into mechanical energy due to the memory effect. Shape-memory alloys are also referred to as memory metals. They can transfer very large forces in a plurality of 100,000s (hundreds of thousands) of motive cycles. The shape conversion is based on the temperature-dependent lattice transformation of two different crystal structures of a material. A shape change is effected by heating the shape-memory alloy. The reversion of the shape when the shape-memory alloy cools can be forced by the action of an external (mechanical) force. For this purpose, a means can be provided for applying a mechanical force, in particular a spring. Furthermore, provision can be made for the return means to feature a second shape-memory alloy which effects the rotational movement of the transfer means in the second direction in response to a control signal. The use of shape-memory alloys as actuators allows a particularly simple design structure of the device for adding and/or dosing the fluid, and hence economical manufacturing.

The return means can feature a section comprising at least one catch, wherein said section can be moved longitudinally by the second shape-memory alloy and can be made to engage with the transfer means in order to effect a rotational movement in the second direction. Consequently, the return means does not have to be actively connected to the transfer means at all times, and therefore modest forces need to be overcome when activating the transfer means using the opening means in particular.

In order to cause heating of the first and/or second shape-memory alloy for the purpose of shape change of the shape-memory alloy, provision is made for connecting a PTC resistor in series with the first and/or second shape-memory alloy. This means that a shared PTC resistor can be provided for the first and the second shape-memory alloy. It is also possible to connect a dedicated PTC resistor in each case to the first or second shape-memory alloy.

The gate in the chamber preferably features a membrane which is connected to the support. In this case, for example, the gate can be formed by a flexible impermeable membrane which is permanently connected to the support, and by means of which the chamber is divided into a first and a second chamber section, and which is permanently connected in a first chamber section to a valve stem end that is opposite to the valve head. The membrane provides a seal for the actuator system against the fluid. At the same time, the volume of the chamber and hence the preloaded fluid contained therein can be determined by the form of the membrane. The membrane material is freely selectable, wherein consideration is given to rubber in particular.

The valve stem is preferably pretensioned in a sprung manner. For example, the valve stem can be surrounded by a compression spring in the first chamber section in order to apply a force which acts on the gate of the outlet. It is thus ensured that, after activation of the gate means by the compression spring, the gate is securely pressed against the outlet in order to prevent any further escape of fluid from the chamber.

In an embodiment, the device is designed for releasing a fluid by means of gravitational effect and for dosing during an outflow time which can be specified.

A cleaning-agent dosing system according to the invention comprises at least one device for dosing and/or adding a fluid as described above.

The invention also includes a cleaning-agent dosing system for dishwashers.

BRIEF DESCRIPTION OF THE DRAWINGS

The invention is described in greater detail below with reference to the figures, in which.

DETAILED DESCRIPTION OF THE PRESENT INVENTION

Figure 1:
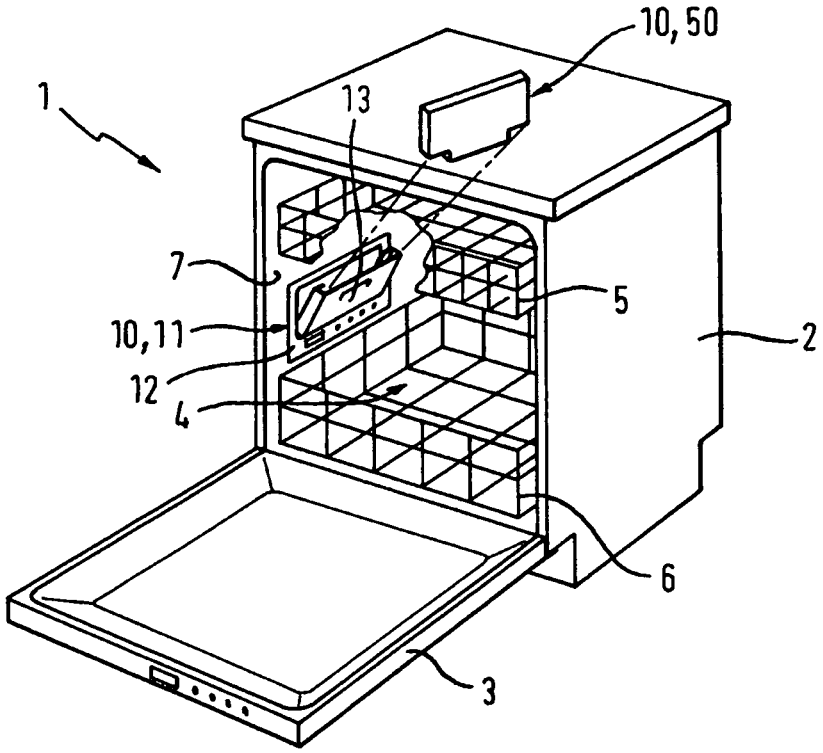
FIG. 1 shows an inventive dishwasher comprising a cleaning-agent dosing system which is arranged in a container wall of the dishwasher.

FIG. 1 shows a dishwasher 1 according to the invention, featuring a door 3 which is mounted on a housing 2 in a hinged manner. The door 3 is illustrated in its open position in the figure. Kitchenware baskets 5, 6 are arranged in a known manner in a washing compartment 4 which can be closed by the door 3. A cleaning-agent dosing system 10 comprising a cleaning-agent dispenser 11 and a cartridge 50, which contains at least two cleaning agents which are stored separately from each other, is arranged by way of example in a container wall 7 of the housing 2. FIG. 1 shows the arrangement of the cleaning-agent dosing system 10 between the upper basket 5 and the lower basket 6, said arrangement being preferred in this case. In this case, the cleaning-agent dispenser 11 which holds the cartridge 50 is arranged in a section of the container wall 7 which is positioned near to the door opening, in order to facilitate the insertion and removal of the cartridges 50 into and from the cleaning-agent dispenser 11 by the user.

The cleaning-agent dosing system 10, as illustrated in the dishwasher according to FIG. 1, shows the cleaning-agent dispenser 11 arranged in the container wall 7. This comprises a housing 12 and a cover 13 which is pivotably mounted relative to the housing. When the cover 13 is in its open position as illustrated in FIG. 1, the cartridges 50 can be inserted into the cover from within the washing compartment 4. For the purpose of holding and securing, the cover 13 includes e.g. two symmetrically arranged retaining brackets which have e.g. an L-shaped form and are adapted to the size of the cartridge 50, such that the retaining brackets hold the cartridge 50 securely following insertion. The cover features a molded seating surface, such that the cartridge 50 comes to rest in a defined position. As a result of closing the cover, the cartridge is moved into a holding compartment of the cleaning-agent dispenser 11 and pushed into its final position by means of catches and/or projections if applicable on the housing of the cleaning-agent dispenser.

Figure 2:
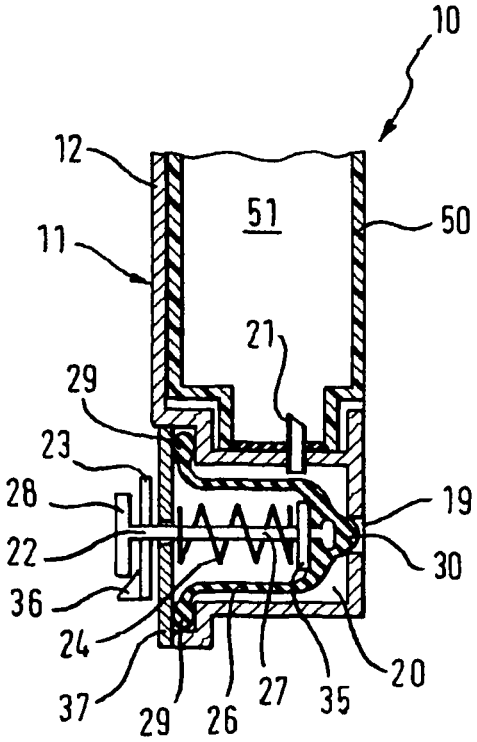
FIG. 2 shows a section through a cleaning-agent dosing system according to the invention, wherein a device arranged in a dosing chamber is illustrated and cleaning agent can be supplied from a cartridge into the washing compartment of the dishwasher by means of said device.

FIG. 2 shows a section through a cleaning-agent dosing system 10 according to the invention. Provision is made for one or more outlets 19 in the housing 12 of the cleaning-agent dispenser 11. The outlets 19 open into a dosing chamber 20 in each case, only one dosing chamber 20 and correspondingly one outlet 19 being visible in the cross section in FIG. 2. The dosing chamber 20 is connected to a chamber 51 of the cartridge 50 via a canula 21. The delivery of the cleaning agent can be effected using gravity. The cartridge 50 features e.g. five chambers for holding in each case a cleaning agent or a cleaning-agent mixture. In this case, the size of the individual chambers is preferably dimensioned according to the volumes required during a predetermined number of washing cycles. The volume of the various cleaning agents in the chambers is preferably proportioned such that all the chambers are fully emptied after a specific number of washing cycles, preferably between 20 and 40, and preferably approximately 30. Each of the chambers is equipped with an openable gate in the form of a membrane, a film or an elastomer. The membrane closes the individual chambers 51 in the manner of a seal, such that no cleaning agent can escape during the storage and transport of the cartridges 50. When the cartridge 50 is inserted into the cleaning-agent dispenser 11, the membranes are pierced by the canulas (cf. FIG. 2) which are correspondingly arranged in the cleaning-agent dispenser 11, such that cleaning agent can be added into the washing compartment in accordance with a corresponding dosing device.

The cartridge is preferably made of plastic and has a width B of approximately 200 mm, a height H of approximately 125 mm and a depth of approximately 25 mm. As a result of these dimensions, it is possible to proportion the volume of the different chambers such that the desired 20 to 40 washing cycles can be carried out using one cartridge.

A dosing and adding device is arranged in the dosing chamber 20 and, in the present exemplary embodiment, comprises an impermeable membrane 26 which is movably held in the dosing chamber 20 and an actuator system for the membrane 26. The membrane 26 divides the dosing chamber 20 into a first and a second chamber section, wherein the first chamber section holds components of the actuator system and the second chamber section is connected to the outlet 19. The membrane 26 is shaped such that it can be moved between a position which closes the outlet 19 and a position which opens the outlet. The membrane 26 has a foxglove-like form in cross section, wherein a tip of the membrane corresponds to the outlet 19. At its end, the membrane 26 has a collar 29 which fits very closely against a support 37. In the first chamber section, a valve lifter 22 projects through the support 37 from outside the dosing chamber 20. The valve lifter 22 comprises a valve stem 27 and a valve head 28, the latter being arranged on the outside of the dosing chamber 20. That end of the valve stem 27 which is located on the inside of the first chamber section features a bulb 30 which is surrounded by membrane material of the membrane 26 in order to produce a mechanical connection. Adjacent to this, the valve stem 27 features a thrust bearing 35. A compression spring 24 is arranged between the thrust bearing 35 and a main side which is associated with the inside of the dosing chamber 20. A rotatably mounted transfer means 23 which is designed as a valve activation lever is arranged between the valve head 28 and an external main side of the support 37. The valve activation lever 23 features a wedge-shaped or ridge-shaped projection 36 on its side which faces the valve head 28.

All parts of the actuator system described above can be mounted on the support 37. In order to locate the dosing and adding device in the dosing chamber, it is merely necessary to attach the support to the housing of the cleaning-agent dosing system.

Figure 3:
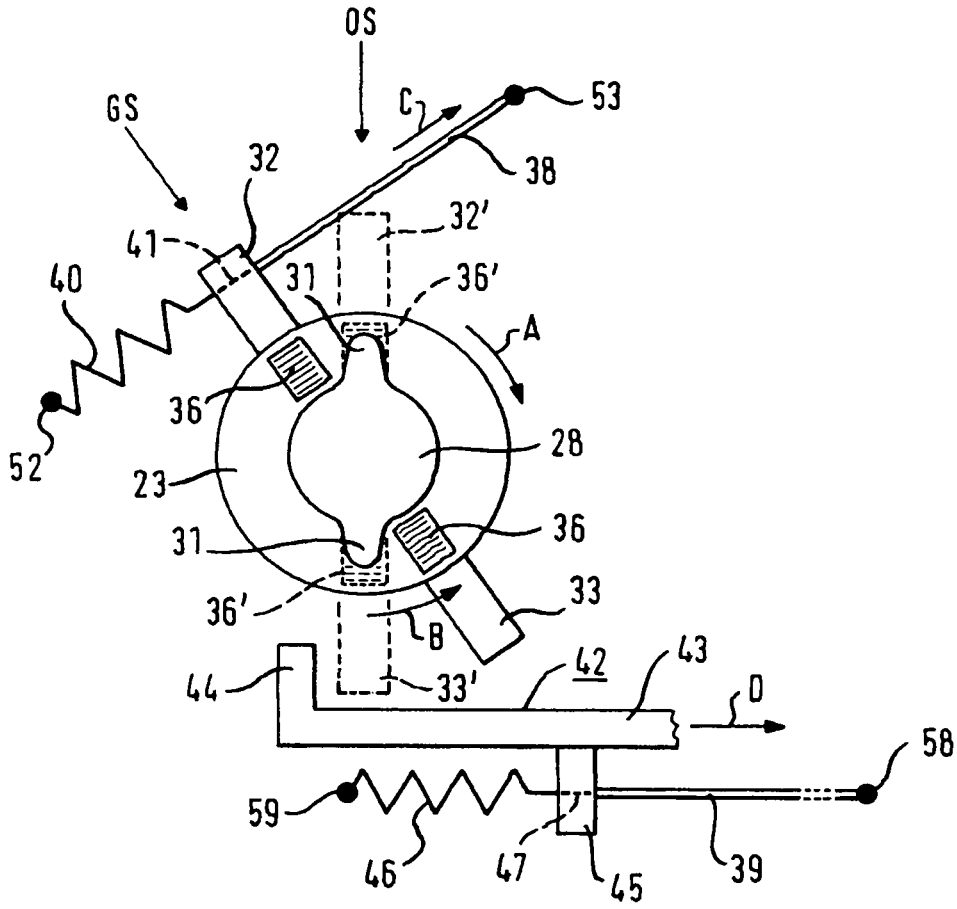
FIG. 3 shows a plan view of an inventive device for dosing and/or adding a fluid.

The functionality is explained in greater detail below with reference to the FIGS. 3 and 4. FIG. 3 shows a magnified illustration of the inventive dosing and adding device in a plan view. In this illustration, it can be seen that the valve head 28 features shoulders 31 on opposite sides. It is also clearly evident that the valve activation lever 23 comprises two engagement elements 32, 33 which are arranged on opposite sides and can be designed as a unitary and integral part of the valve activation lever 23. Arranged adjacently and corresponding to the engagement elements 32, 33 are e.g. wedge-shaped projections 36. Attached to the engagement element 32 is a shape-memory alloy 38 which is attached to a contact pin 53 at its other end. The contact pin 53 is made of an electrically conductive material and is anchored in the support 37 (cf. FIG. 5), where it is in electrical contact with reciprocal contacts 54. A conductor 40 is arranged opposite the shape-memory alloy 38 and is attached at its other end to an electrically conductive contact pin 52. The contact pin 52 is likewise anchored in the support 37 in an electrically conductive manner as illustrated in FIG. 5. The contact pin 52 can be designed to extend within the support 37 using the so-called insert technique. The conductor 40 takes the form of a tension spring and is electrically connected to the shape-memory alloy 38 via a conductor 41 which passes through the engagement element 32. This is illustrated by the broken line having the reference sign 41. The electrical connection between the conductor 40 and the shape-memory alloy 38 can be made within the engagement element 32.

In FIG. 3, the continuous lines (cf. reference signs 32 and 36) show the dosing and adding device in a state in which the membrane fits very closely against the outlet (GS: closed position). This means that any addition of cleaning agent via the outlet into the washing chamber is not possible in this position. In order to open the gate, a current is applied to the shape-memory alloy 38, said current flowing through a PTC resistor (not shown in FIG. 3) which is connected in series with the shape-memory alloy 38. As a result of the properties of the PTC resistor and the warming of the shape-memory alloy 38, the latter contracts (cf. arrow C), thereby causing a rotational movement in the direction of the arrow identified as "A". In this case, a position is finally reached which is identified by the broken lines 32' and 36'. As a result of the rotation, the projections 36 are pushed under shoulders 31, whereby the membrane is removed away from the outlet. The desired opening of the gate (OS: open position) is produced thereby.

If the conductor 40 in the form of a spring element is dimensioned correspondingly, the shape-memory alloy 38 could be brought back to the starting position as a result of the return force of the conductor 40 as soon as the current flow through the shape-memory alloy is interrupted and the introduction of heat is discontinued. However, since this would only allow sluggish activation for closing the dosing and adding device in some circumstances, provision is made for a return means 42 which is assigned to the engagement element 33. The return means 42 comprises a longitudinal section 34 and one (or more) catches 44 extending perpendicularly therefrom. A catch 45 which is arranged on the other side of the longitudinal section 34 is connected to a shape-memory alloy 39 and a conductor 46 having the form of a spring element. The shape-memory alloy 39 and the conductor 46 are connected to contact pins 58, 59 in an electrically conductive manner and are electrically connected to each other via a conductor 47.

In order to move the dosing and adding device from its open position OS into its closed position GS, a current is passed through the shape-memory alloy 39 via a serially connected PTC resistor (not shown). A contraction of the shape-memory alloy 39 occurs as a result of this (cf. arrow D). In this case, the catch 44 engages with the engagement element 33, thereby causing a rotational movement in the direction of the arrow identified as "B", until the engagement element 33 again assumes the position shown by the continuous line and the membrane lies very closely against the outlet.

In this case, the original state of the shape-memory alloy 38 is re-established at the same time with assistance from the sprung conductor 40. The initial state of the return means 42 can be re-established in a corresponding manner by moving the valve activation lever 23 from its closed position GS to the open position OS.

Depending on the number of chambers provided in a cartridge, a number of dosing and adding devices are provided. In the exemplary embodiment according to FIG. 4, five such devices are shown by way of example. From this illustration, it can also be seen that the return means 42 can be assigned to all dosing and adding devices according to the invention. Irrespective of which and how many of the dosing and adding devices were open, closure of all open gates is effected as a result of the movement of the return means 42 in a lateral direction.

Figure 4:
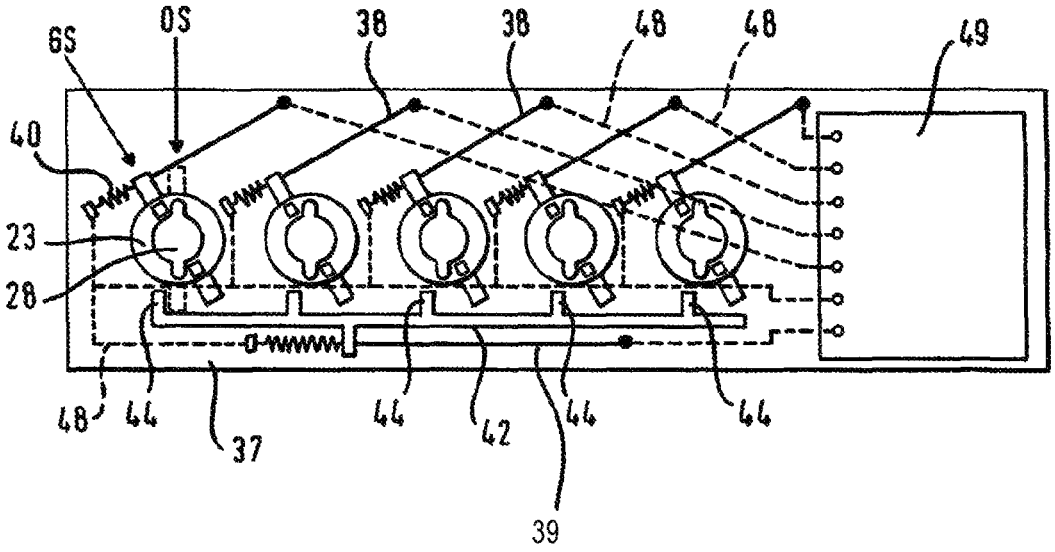
FIG. 4 shows a plan view of a plurality of devices for separate dosing and/or adding of fluids for a cleaning-agent dosing system.
Figure 5:
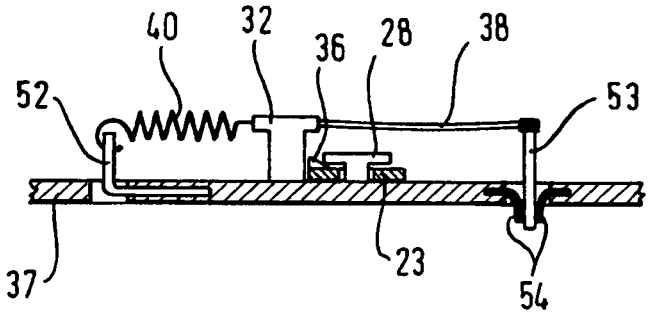
FIG. 5 shows a section through the device in FIG. 3.

It is also clearly visible from FIG. 4 that all parts of the actuator system are arranged on the support 37. Conductor tracks 48 which run inside the support 37 and can be produced using e.g. the insert technique are indicated by the broken lines in this context. The control, i.e. injection of current into the shape-memory alloys 38, 39, is performed by a microprocessor 49 which is mounted on the support 37. This can be mounted on the support 37 using e.g. the plug-in technique. The microprocessor 49 can be connected to a control unit of the dishwasher via a flexible cable.

FIG. 5 again shows a section through the device in FIG. 3, wherein the electrical contacting of the conductor 40 and the shape-memory alloy 38 via contact pins 52, 53 is evident in particular. Also evident is the engagement element 32, which is an integral component of the valve activation lever 23, wherein a rotation of the valve activation lever 23 is caused by a contraction of the shape-memory alloy 38 due to warming.

Figure 6:
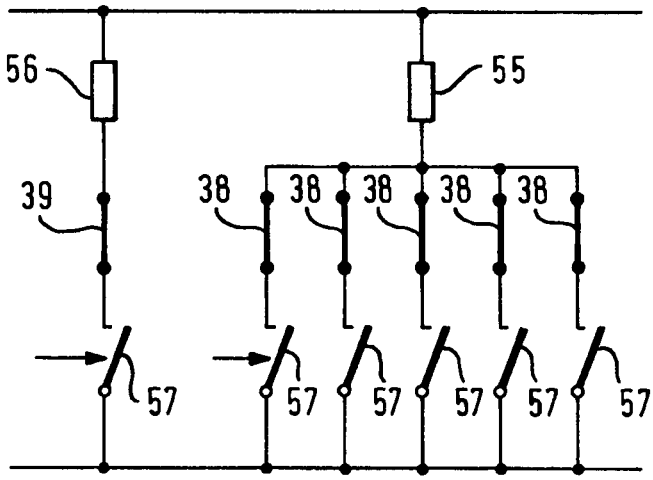
FIG. 6 shows an electrical equivalent circuit diagram of the adding device according to the invention.

FIG. 6 shows an electrical equivalent circuit diagram, in which it is evident in particular that just one shared PTC resistor 55 is assigned to the shape-memory alloys 38 for opening the gate. An additional PTC resistor 56 is assigned to the shape-memory alloy 39. A switch 57 which can be controlled by the microprocessor 49 is provided in each case for activating each individual shape-memory alloy. Depending on the layout of the system, a shared PTC resistor could also be provided for the shape-memory alloy 38 and the shape-memory alloy 39. However, the arrangement that is shown has the advantage that short switching times can also be realized.

LIST OF REFERENCE SIGNS

1 Dishwasher
2 Housing
3 Door
4 Washing compartment
5 Kitchenware basket
6 Kitchenware basket
7 Container wall
10 Cleaning-agent dosing system
11 Cleaning-agent dispenser
12 Housing
13 Cover
19 Outlet
20 Dosing chamber
21 Canula
22 Valve lifter
23 Valve activation lever
24 Spring
26 Seal/membrane
27 Valve stem
28 Valve head
29 Collar of the seal/membrane
30 Bulb of the valve stem
31 Shoulder
32 Engagement element
33 Engagement element
35 Thrust bearing
36 Projection
37 Support
38 Shape-memory alloy
39 Shape-memory alloy
40 Conductor
41 Conductor
42 Return means
43 Longitudinal section
44 Catch
45 Catch
46 Conductor
47 Conductor
48 Conductor track
49 Microprocessor
50 Cartridge
52 Contact pin
53 Contact pin
54 Reciprocal contact
55 PTC resistor
56 PTC resistor
57 Switch
58 Contact pin
59 Contact pin
A First direction of rotation
B Second direction of rotation
C Direction
D Direction
GS Closed position
OS Open position

The invention claimed is:

1. A water-conducting domestic appliance, in particular a domestic dishwasher, the water-conducting domestic appliance comprising:

a washing compartment for receiving items therein that are to be subjected to a handling process by the water-conducting domestic appliance; and a cleaning agent dosing system, the cleaning agent dosing system having a dosing device for dosing at least one cleaning agent, in particular a liquid cleaning agent, into the washing compartment of the water-conducting domestic appliance, the dosing device including a dosing chamber for holding a cleaning agent, an outlet, a gate for opening and closing the dosing chamber, and an actuator system for actuating the gate to move between a dosing chamber opening position and a dosing chamber closing position, the actuator system including (a) transfer means including a cam having at least one of a wedge-shaped projection and a ridge-shaped projection disposed thereon for selective operational contact with a portion of the gate such that a predetermined rotational movement of the cam causes linear movement of the gate, (b) opening means for effecting a movement of the cam in a first direction with the movement of the cam in the first direction being operable to effect opening of the gate, and (c) return means for effecting a movement of the cam in a second direction with the movement of the cam in the second direction being operable to effect closing of the gate.

2. The water-conducting domestic appliance according to claim 1 wherein the actuator system is disposed on a support member which forms a wall section of the dosing chamber.

3. The water-conducting domestic appliance according to claim 1 wherein the actuator system is disposed on a support member and the support member is configured for operation as a circuit board.

4. The water-conducting domestic appliance according to claim 2 wherein the support member is configured with conductor paths on at least one of a side thereof and internally.

5. The water-conducting domestic appliance according to claim 1 wherein the gate includes a valve lifter with a valve stem and a valve head.

6. The water-conducting domestic appliance according to claim 1 wherein the opening means includes a first shape-memory alloy.

7. The water-conducting domestic appliance according to claim 1 wherein the return means includes a second shape-memory alloy.

8. The water-conducting domestic appliance according to claim 6 and further comprising means for applying a force including an active connection to a shape-memory alloy.

9. The water-conducting domestic appliance according to claim 7 wherein the return means includes a section having at least one catch, wherein said section having at least one catch is configured for longitudinal movement by the second shape-memory alloy is further configured for engagement with the transfer means.

10. The water-conducting domestic appliance according to claim 1 and further comprising a PTC resistor connected in series with at least one of a first shape-memory alloy operatively associated with the opening means and a second shape-memory alloy operatively associated with the return means.

11. The water-conducting domestic appliance according to claim 1 wherein the gate includes a membrane connected to the support member.

12. The water-conducting domestic appliance according to claim 5 wherein the valve stem is pretensioned using a spring.

13. The water-conducting domestic appliance according to claim 1 wherein the dosing system includes an adding device and at least one of the dosing device and the adding device is designed for releasing a fluid by gravity.

14. The water-conducting domestic appliance according to claim 1 wherein the dosing system includes an adding device and at least one of the dosing device and the adding device is configured for dosing during a predetermined outflow time.

15. A cleaning-agent dosing system for a dishwasher comprising a dosing device for dosing at least one cleaning agent, in particular a liquid cleaning agent, into the washing compartment of the water-conducting domestic appliance, the dosing device including a dosing chamber for holding a cleaning agent, an outlet, a gate for opening and closing the dosing chamber, and an actuator system for actuating the gate to move between a dosing chamber opening position and a dosing chamber closing position, the actuator system including (a) transfer means including a cam having at least one of a wedge-shaped projection and a ridge-shaped projection disposed thereon for selective operational contact with a portion of the gate such that a predetermined rotational movement of the cam a causes linear movement of the gate, (b) opening means for effecting a movement of the cam in a first direction with the movement of the cam in the first direction being operable to effect opening of the gate, and (c) return means for effecting a movement of the cam in a second direction with the movement of the cam in the second direction being operable to effect closing of the gate.

* * * * *